US007682418B2

(12) United States Patent
Sarbendu et al.

(10) Patent No.: US 7,682,418 B2
(45) Date of Patent: Mar. 23, 2010

(54) CORED WIRE INJECTION PROCESS IN STEEL MELTS

(75) Inventors: Sanyal Sarbendu, Jamshedpur (IN); Chandra Sanjay, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 29 days.

(21) Appl. No.: 10/589,028

(22) PCT Filed: Feb. 10, 2005

(86) PCT No.: PCT/IN2005/000042

§ 371 (c)(1),
(2), (4) Date: Sep. 18, 2007

(87) PCT Pub. No.: WO2005/078142

PCT Pub. Date: Aug. 25, 2005

(65) Prior Publication Data

US 2008/0105086 A1 May 8, 2008

(30) Foreign Application Priority Data

Feb. 11, 2004 (IN) ..... 57/KOL/04

(51) Int. Cl.
*C21C 7/076* (2006.01)

(52) U.S. Cl. ..... 75/526; 75/565; 75/569

(58) Field of Classification Search ..... 75/526
See application file for complete search history.

(56) References Cited

U.S. PATENT DOCUMENTS

| | | | | |
|---|---|---|---|---|
| 4,085,252 | A * | 4/1978 | Karinthi et al. | 428/576 |
| 4,094,666 | A * | 6/1978 | Ototani | 75/526 |
| 4,512,800 | A * | 4/1985 | Wirth, Jr. | 266/226 |
| 4,531,972 | A * | 7/1985 | Gueussier et al. | 75/526 |
| 4,832,742 | A * | 5/1989 | Ototani | 75/304 |
| 4,892,580 | A | 1/1990 | Neuer | |
| 2001/0010181 | A1 | 8/2001 | Zasowski et al. | |

FOREIGN PATENT DOCUMENTS

| | | |
|---|---|---|
| EP | 0 123 632 | 10/1984 |

* cited by examiner

*Primary Examiner*—George Wyszomierski
*Assistant Examiner*—Tima M McGuthry-Banks
(74) *Attorney, Agent, or Firm*—The Webb Law Firm

(57) ABSTRACT

The present invention provides a cored wire injection process for introducing fluxes and alloying additives in liquid steel bath. The bath temperature and chemistry of the liquid steel is adjusted according to requirements in a secondary treatment unit. The additives are released from the cored wire, while controlling the zone of release. The yield of the additives can thus be controlled by changing dimension of the cored wire and speed of injection to suit the grade of steel processed and the treatment temperature. The zone of release is preferably close to the bottom of the ladle and the diameter and sheath thickness of the cored wire are preferably more than 13 mm and 0.4 mm respectively.

7 Claims, 3 Drawing Sheets

CORED WIRE INJECTION PROCESS IN STEEL MELTS

CROSS REFERENCE TO RELATED APPLICATIONS

This application is the national phase of International Application No. PCT/IN2005/000042, filed Feb. 10, 2005, which claimed priority to Indian Application No. 57/KOL/04, filed Feb. 11, 2004.

BACKGROUND OF THE INVENTION

1. Field of Invention

The present invention relates to a cored wire injection process in steel melts. In particular, it relates to the dimension and the injection speed of a cored wire used in steel plants to inject fluxes and alloying additives in molten steel baths.

The objectives of such additions are either to refine the steel further or to adjust the composition to meet the chemistry for the final applications of the steel. This invention is aimed at decreasing the loss of additives during the injection in the steel bath and thereby reducing the consumption.

2. Description of Related Art

Steel making is essentially an oxidation process where the impurities (i.e. the undesirable elements) of the molten metal (either pig iron or melted scrap) are preferentially oxidized to join the slag along with fluxes. Some amount of oxygen and the inclusions, like alumina formed due to subsequent deoxidation process, remain in the steel. These oxygen and inclusions not only create operational problems during further processing of the steel in continuous casting and rolling but also are mostly detrimental to the product quality. The major challenge to the steel plant operators is to reduce their content below a certain level.

The use of calcium is beneficial in this direction. However, the introduction of it in liquid steel bath is very difficult due to its low density and low vapour pressure. The advent of cored wire injection technology and the development of calcium bearing material like calcium-silicide, calcium-iron etc have enabled the steel plant operators to introduce the calcium in steel baths.

A large number of steel plants have also started using cored wire with Lead, Sulphur, Selenium, Tellurium and Bismuth as filing materials. A cored wire is a continuous steel tube filled with either a calcium bearing material or a ferroalloy material. This wire is fed in the liquid steel bath contained in a ladle with the help of a wire feeder. This appears to be the most suitable means to introduce a particular element into the melt while attaining a high degree of homogenization and ensuring its metallurgical effectiveness. There exists equipment today that is capable of feeding wire at very controlled rates into the steel-melts.

The distribution of the amount of calcium injected can be in undesirable reactions like some amount being vapourised and lost to the atmosphere in unreacted condition and some amount of calcium reacting with ladle top also lost.

Some amount of calcium will react with the dissolved oxygen and inclusions present in the steel and join the slag. Some amount of calcium will remain in the steel as retained calcium. The last mentioned reactions are desirable reactions.

Ideally the injected calcium should be involved in the desirable reactions only. The yield of calcium can be defined as the rate of amount of retained calcium to the amount of calcium injected.

The yield of calcium in the cored wire injection process is at the most 30% and sometimes it becomes as low as 2% depending on grades of steel processed and the operating conditions.

When the steel plants are desperately looking for cost reduction options, there exists a need for an improvement in the yield of calcium. An increase of 10% in the yield of calcium should lead to big savings.

The description for addition of calcium given above holds good for other alloying additives also.

SUMMARY OF THE INVENTION

The main object of the present invention therefore, is to increase the yield of calcium in a cored wire injection process.

It has been observed that the utilization of calcium and other additives is maximum when the material is released form cored wire very close to the bottom of the ladle so that the losses through the undesirable reactions mentioned above can be kept to a minimum. The material in released as and when the sheath melts completely. The key factors which determine the zone of release of the material are the speed of injection and the dimensions of the cored wire keeping the grade of steel processed, treatment temperature and the material and sheath properties constant.

The main object of the invention is achieved by controlling the zone of release of the material and thereby the yield of calcium and/or other additives by changing the dimensions of the cored wire and the speed of injection. The diameter of the cored wire and the thickness of the mild steel sheath are varied along with a suitable speed of injection to ensure that the material is released very close to the bottom.

The variation in the diameter of wire for a 140 ton ladle having 3 meter bath depth is from 13 mm to 18 mm and the variation of sheath thickness is from 0.4 mm to 0.8 mm. The exact combination of the diameter, sheath thickness and the speed depends on the grade of steel processed and the treatment temperature.

Thus the present invention provides a cored wire injection process for introducing fluxes and alloying additives in liquid steel bath, comprising the steps of adjusting the bath temperature and chemistry of the liquid steel in a secondary treatment unit according to requirements; and releasing said additives from said cored wire, while controlling the zone of release of said additives, thereby controlling yield of the additives by changing the dimensions of said cored wire and speed of injection to suit the grade of steel processed and the treatment temperature.

The invention will now be described with the help of the accompanying drawings.

BRIEF DESCRIPTION OF THE DRAWINGS

FIG. 2(*b*) shows variation of traveled distance with different wire dimensions;

DETAILED DESCRIPTION OF THE INVENTION

Figure 1:
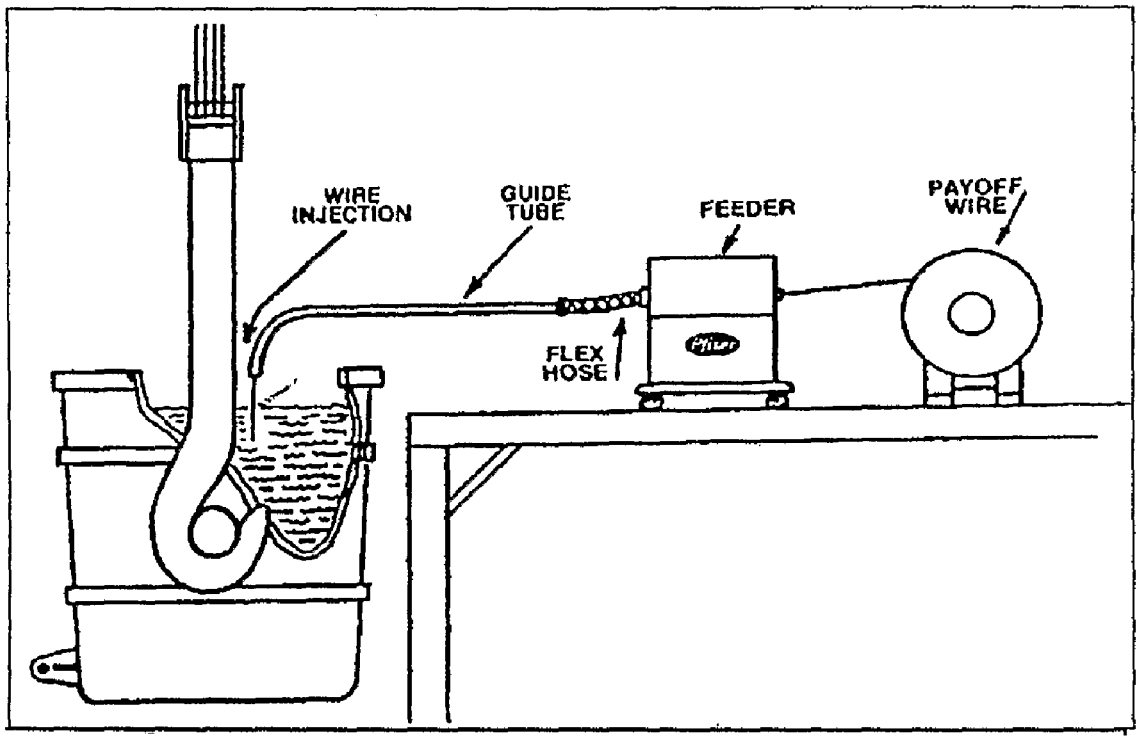
FIG. 1 shows in schematic form the use of cored wire in steel bath.

The process of injecting flux and other alloying additives by means of a cored wire has been illustrated schematically in FIG. 1.

After the steel is made in the primary steel-making vessel, the liquid steel is carried in a ladle to the secondary treatment unit. The main purpose of the secondary treatment unit is to further refine the steel, adjust the bath temperature and chemistry to suit the demand of the next processing unit i.e. casting unit. The presence of dissolved oxygen and inclusions in the liquid steel poses problem to the smooth operation of casting and also deteriorate the product quality. The calcium treatment of the steel, thus, becomes essential to control the dissolved oxygen level as well as the shape and characteristics of the inclusions. The liquid steel is treated with the calcium and/or other additives bearing cored wires in the secondary processing units.

The present invention shows that the variety of steel grades a steel shop produces, requires varying specification of the cored wire to exploit maximum benefit from it. It has been already established that, if the additives are released at the maximum possible depth of the bath (i.e. close to the ladle bottom), the maximum benefit can be obtained.

In the present invention an elaborate mathematical model has been developed to predict distance travelled by a cored wire before complete melting of the sheath and thereby releasing the filling material when injected in a molten bath. Based on the model results and the experimental results discussed later in the "experimental work" section, it is clear that the most common cored wires of 13 mm diameter with 0.4 mm sheath thickness is not suitable for steel grades having high liquidus temperature and/or high treatment temperature in 140 ton capacity ladle with around 3 meter bath depth. The best wire for such applications should have 18 mm diameter and 0.8 mm sheath thickness and the injection speed should be around 110 m/min.

The parameters of the wire which effect the distance travelled are discussed below. The distance travelled is the distance travelled by the wire before the material is set free into the melt and is an indicator of the point of release of the material in the ladle.

The melting of wire and subsequent release of the material depends on the amount of heat transferred from the bath to the wire which in turn depends on the heat transfer coefficient only when the superheat and wire diameter are fixed. The heat transfer coefficient is directly proportional to the wire speed. Thus, the speed of injection decides the melting behavior when all other parameters are constant; for example higher speed results in a lower melting tire.

Figure 2A:
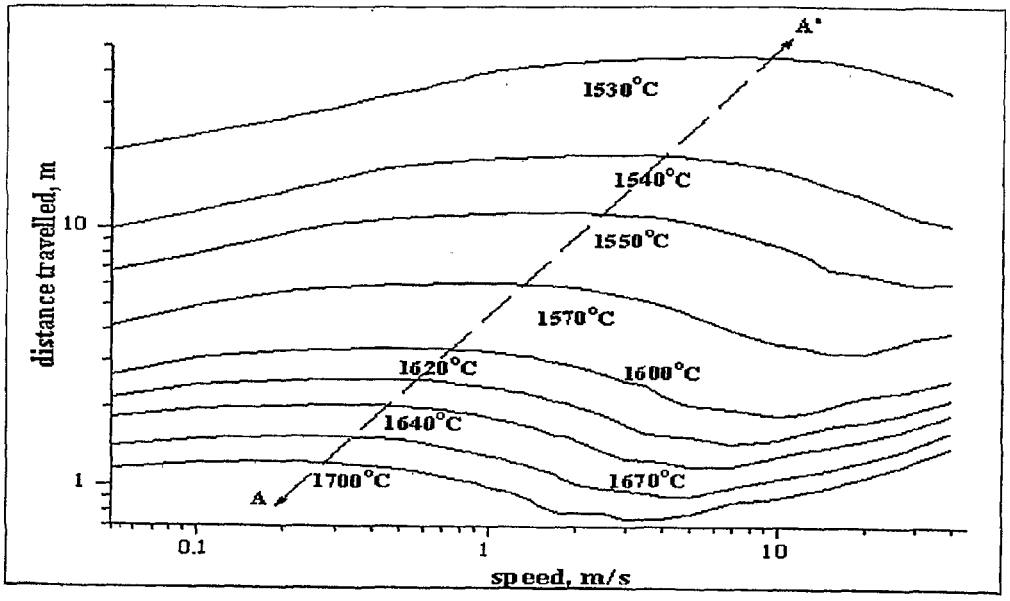
FIG. 2(*a*) shows the traveled distance before melting of 13 mm wire with 0.4 mm sheath thickness.
Figure 2B:
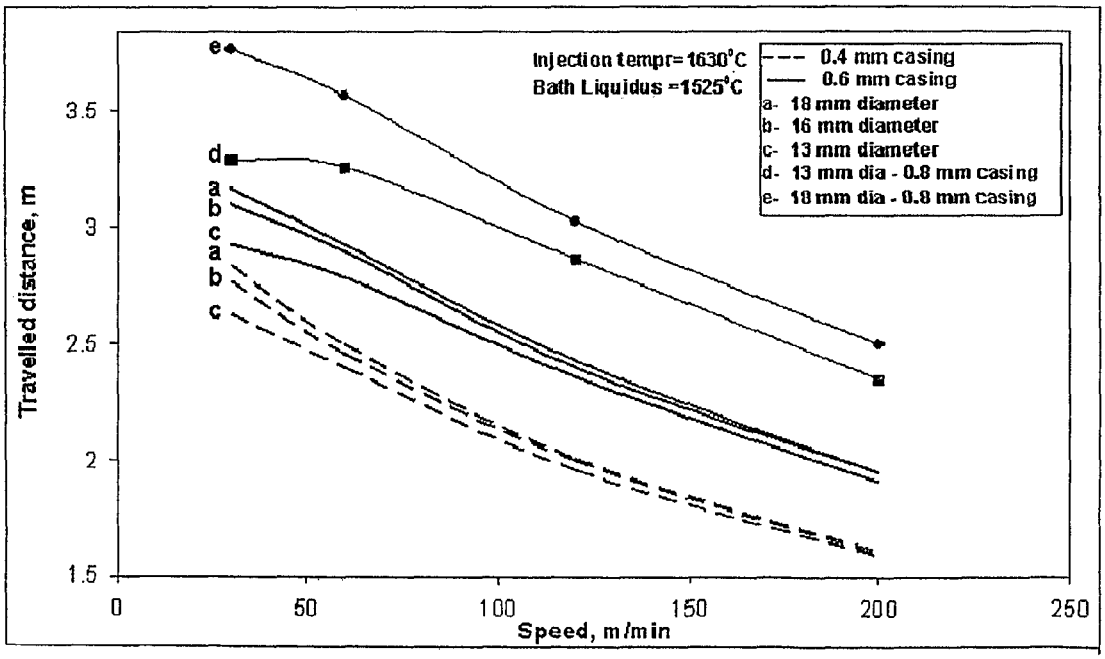

FIG. 2(*a*) shows the variation of distance travelled for a typical wire specification. It is observed that the distance travelled by the wire does not monotonically increase with the increase in speed; rather it passes through a maximum and beyond a critical speed it decreases again. As it is already discussed the melting time decreases with the increase in speed. However, the decrease in the melting time on account of this factor is not necessarily accompanied by a decrease in the distance travelled. On the contrary, as evident from the FIG. 2(*a*), the distance travelled, initially increases with speed (up to line AA') and reaches a maximum at a certain speed (speed at the intersection with line AA") and then decreases (after line AA'). The position of this intersection point changes with the bath temperature.

The change in the distance travelled by the wire with increase in the speed of injection is dependent on the relative dominance of the two competing factors. The increase in speed clearly implies that if the melting time were to remain unchanged, the distance travelled would be more. However, since the heat transfer coefficient also increases with the speed the melting time decreases. Clearly, whether the injected wire will move deeper or not would be dictated by whether the decrease in melting time is significantly higher or not. In the region of speed lower than the value indicated by the line AA', the first factor dominates and thus, the distance travelled increases with the speed. After this point, the dominance of the second factor prevails and so as the speed increases the distance travelled decreases in this region. It suggests that depending on the prevailing conditions in a steel shop, an increase in speed may not necessarily help the wire to travel nearer to the bottom of the ladle before release of the material.

The second rise in the curves of distance travelled after AA' is not of practical interest because of the unrealistic speed and/or very high treatment temperatures. However, this phenomena occurs as there is a minimum time required for the casing to heat up to its melting point to initiate melting. The wire, travelling at a very high speed, travels to a higher distance by this time and thus, the distance travelled by the wire increases at a very high speed.

The problem of early release of material may result in higher evaporation loss as well as loss of unreacted material by the reaction with the top slag. The possibilities of increasing distance travelled by the wire in such situations by modifying wire dimensions have been assessed in this section. Now, if the wire diameter is increased, the total heat requirement for melting of the wire increases as there is more wire mass to be melted and as a result the release of the material is delayed. Similarly, if the casing thickness is increased, the heat requirement for its melting increases which again results into the delayed melting of the wire.

To find out the suitable dimensions of the wire for certain critical applications, the study was carried out for three wire diameters (13, 16 and 18 mm) and three casing thickness (0.4, 0.6 and 0.8 mm) and the results have been plotted in FIG. 2(*b*). The process parameters for a typical low carbon heat (liquidus of bath as 1525° C. and bath temperature at the time of injection as 1630° C. are considered for this figure. Three curves for 0.4 mm casing thickness, if compared, clearly shows the consistent increase in distance travelled when the diameter is increased from 13 mm (dashed line 'c') to 16 mm (dashed line 'b') and then to 18 mm (dashed line 'a'. Similarly observation can be made when the three curves for 0.6 mm casing thickness of different wire diameter (solid lines 'a', 'b' and 'c') are compared.

To estimate the effect of casing thickness alone, the set of three curves for 13 mm wire diameter with three different casing thickness viz. 0.4 mm (dashed line 'c'), 0.6 mm (solid line 'c') and 0.8 mm (solid line 'd') are compared. It is evident from this figure that effect of casing thickness is more prominent than that of wire diameter. For example, while the increase in diameter from 13 mm (dashed line 'c') to 18 mm (dashed line 'a') keeping the casing thickness fixed at 0.4 mm has a negligible effect on the distance travelled (at the injection speed of 200 m/min), the increase in casing thickness from 0.4 mm (dashed line 'c') to 0.8 mm (line 'd') for the wire diameter of 13 mm increases the distance travelled by around 0.8 m (at the injection speed of 200 m/min).

However, from practical point of view casing thickness can not be increased too high. Also there is a limitation on the injection speed; injection speed usually can not be lowered below 110 m/min. Considering the above practical aspects, there should be a judicial choice of wire diameter, casing thickness and the speed of injection to enable the wire melting near the bottom of the ladle. For example, FIG. 2(*b*) suggests that the 13 mm wire with 0.8 mm casing is more suitable than the 13 mm wire with 0.4 mm casing in case of high superheat melts as the former reaches closer to the ladle bottom before releasing the material. However, the speed of injection required (<100 m/min) to enable this wire (13 mm diameter with 0.8 casing) to reach the bottom of the ladle is somewhat impractical from the operational point of view. The more workable solution, in such cases, would be to increase the wire diameter too along with the increase in casing thickness. Curve 'e' presents such solution; the 18 mm diameter wire with 0.8 mm casing thickness, in this case, can reach the bottom of the ladle at a reasonable injection speed of 110 m/min.

Figure 3:
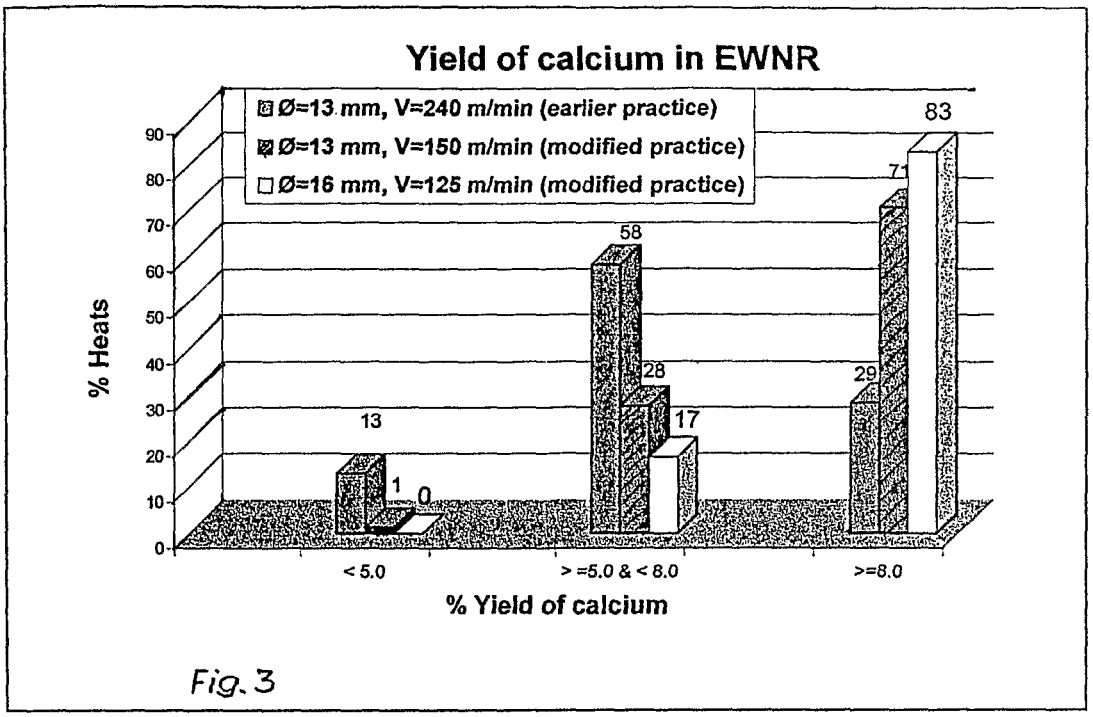
FIG. 3 shows an improvement in the yield of material.

Trials have been conducted in a steel plant result of which has been shown above. The wire used was the conventional calcium-iron material bearing wire of 13 mm diameter with 0.4 mm sheath thickness and the injection was done at a steel bath temperature of 1630° C. when the liquidus of bath was 1525° C. The reduction of injection speed (V) from 240 m/min to 150 m/min has shown an improvement in the yield of calcium as shown in FIG. 3.

Figure 4:
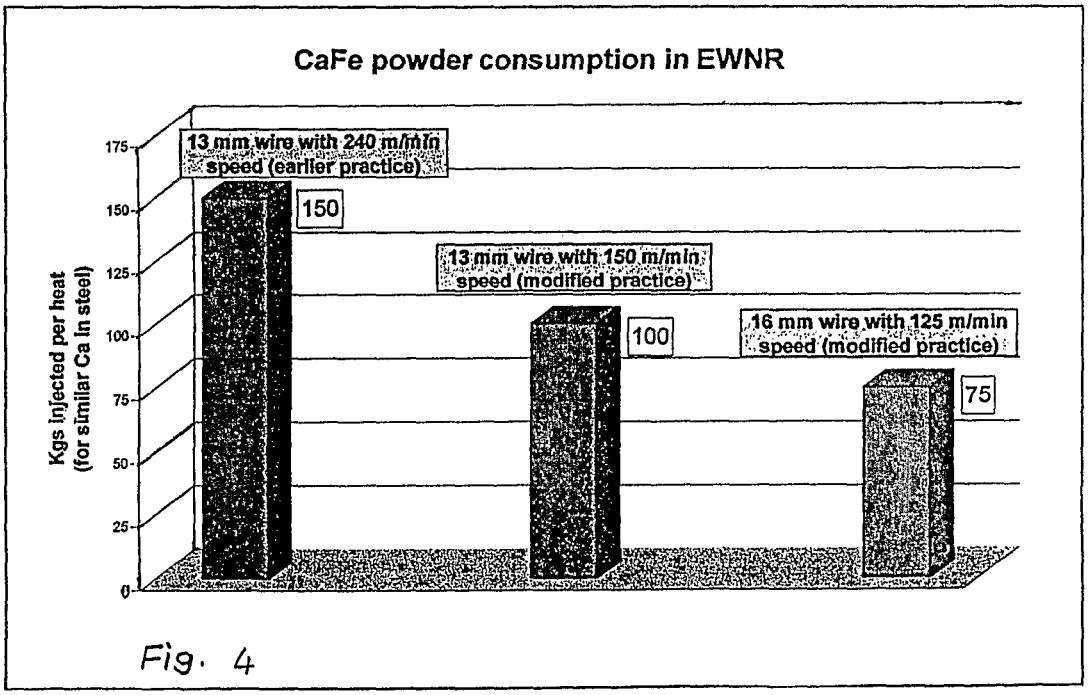
FIG. 4 shows the reduction in consumption of material.

The next phase of trial was conducted using 16 mm calcium iron material bearing wire having 0.4 mm sheath thickness. The further improvement in the yield is evident from the FIG. 3. The reduction in material consumption to achieve the same level of treatment efficiency is shown in FIG. 4.

What is claimed is:

1. A cored wire injection process for introducing fluxes and alloying additives in a liquid steel bath after adjusting a bath temperature and a chemistry of liquid steel in a secondary treatment unit, a ladle of said treatment unit having a bath depth, said injection process comprising the steps of:

determining dimensions of a prefabricated cored wire containing the fluxes and alloying additives based upon a grade of the liquid steel in the liquid steel bath, the bath temperature, a size of the ladle, the bath depth of the ladle, and properties of a cored wire material, wherein the dimensions of the prefabricated cored wire are determined for maximum utilization of said additives;

determining a speed of injection of the prefabricated cored wire into the ladle based upon the grade of the liquid steel in the liquid steel bath, the bath temperature, the size of the ladle, the bath depth of the ladle, and the properties of the cored wire material;

providing a prefabricated cored wire containing the fluxes and alloying additives and having the determined dimensions;

injecting the prefabricated cored wire into the ladle at the determined speed of injection; and releasing said additives from the prefabricated cored wire very close to a bottom of the ladle at a depth approximately equal to the bath depth.

2. The process as claimed in claim 1, wherein the bath temperature is approximately 1630° C., the bath depth is 3 m, the dimensions of the prefabricated cored wire are 18 mm in diameter and 0.8 mm in sheath thickness, and the injection speed is approximately 110 m/min.

3. The process as claimed in claim 1, wherein the ladle is a 140 ton ladle.

4. The process as claimed in claim 1, wherein said additive is a ferro-alloy material.

5. The process as claimed in claim 1, wherein said additive is a calcium bearing material.

6. The process as claimed in claim 5, wherein said calcium bearing material comprises calcium-silicide.

7. The process as claimed in claim 5, wherein said calcium bearing material comprises calcium iron.

* * * * *